US007260903B2

(12) United States Patent
Arp

(10) Patent No.: US 7,260,903 B2
(45) Date of Patent: Aug. 28, 2007

(54) EJECTOR MECHANISM FOR BACK HOE EXCAVATOR BUCKET

(76) Inventor: Regis L. Arp, 25 E. Cemetery Rd., Fairfax, IA (US) 52228

( * ) Notice: Subject to any disclaimer, the term of this patent is extended or adjusted under 35 U.S.C. 154(b) by 12 days.

(21) Appl. No.: 11/150,567

(22) Filed: Jun. 13, 2005

(65) Prior Publication Data

US 2007/0101621 A1 May 10, 2007

(51) Int. Cl.
*B62B 1/00* (2006.01)
*E02F 3/02* (2006.01)

(52) U.S. Cl. ..... 37/431

(58) Field of Classification Search ..... 37/443–445, 37/411, 416, 424–433, 903, 264, 265, 285, 37/341, 379, 380, 407, 409, 410
See application file for complete search history.

(56) References Cited

U.S. PATENT DOCUMENTS 5,901,479 A * 5/1999 Langdon ..... 37/444

* cited by examiner

*Primary Examiner*—Christopher J. Novosad
(74) *Attorney, Agent, or Firm*—Keith S. Bergman; William A. Jeckle

(57) ABSTRACT

Ejector mechanism for the excavator bucket of a back hoe provides two laterally spaced ejector arms irrotatably carried on an ejector arm shaft journaled in horizontal orientation in the chamber of the excavator bucket to fit against the back and adjacent the sides of the bucket and pivot away from the back. A laterally medial powering arm irrotatably carried by the ejector arm shaft communicates through the back and extends forwardly to move upon an angulated ramp carried by the bucket tilting arm mechanism to pivot the ejector arms away from the back of the bucket as the bucket is tilted to a horizontal dumping position. The powering arm shaft is spring biased to maintain the ejector arms adjacent the bucket back when the bucket chamber is empty. The mechanism is retrofitable on various back hoe buckets of present day commerce.

4 Claims, 12 Drawing Sheets

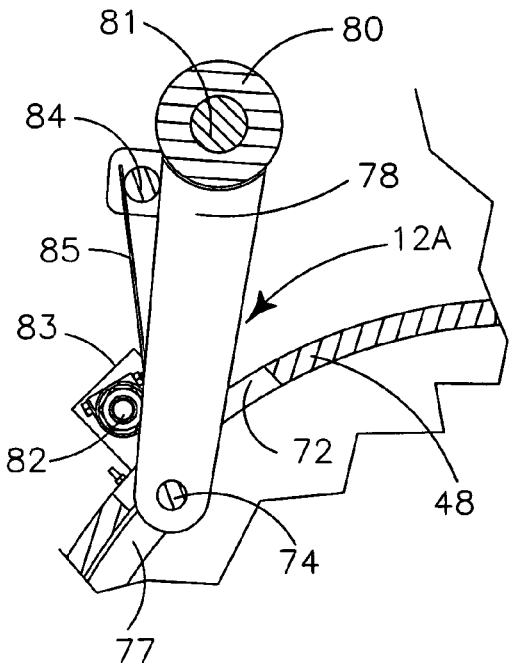
FIG. 13
FIG. 12
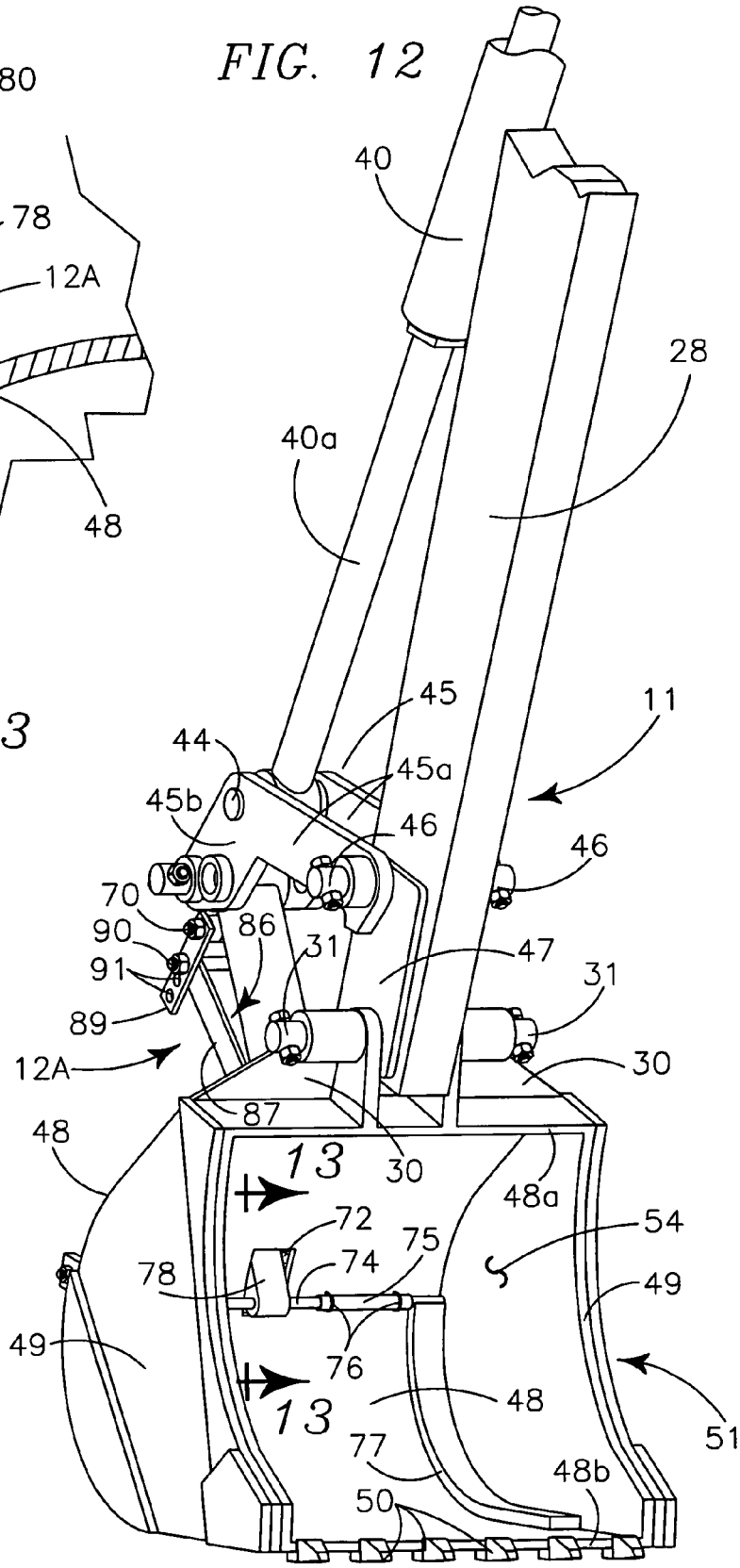

EJECTOR MECHANISM FOR BACK HOE EXCAVATOR BUCKET

RELATED APPLICATIONS

There are no applications related hereto heretofore filed in this or in any foreign country.

BACKGROUND OF INVENTION

1. Field of Invention

This invention relates generally to material handling and more particularly to a load ejector for the excavator bucket of a back hoe that operates automatically responsive to positioning of the excavator bucket.

2. Background and Description of Prior Art

Back hoe excavator buckets and similar buckets on other digging machines pivotally mounted on a supporting beam for motion between somewhat vertical digging positions and somewhat horizontal unloading positions have long been known, are widely used in earth moving and are somewhat standardized in their structure and configuration. These excavator buckets in general have an open front that is pivoted to a vertical orientation to move horizontally through the earth to collect a load of material in the excavator bucket which is then moved to a disposition site the bucket is pivoted to a horizontal orientation, so that the bucket orifice opens downwardly, to allow gravity to remove material therefrom. This operation is effective, however, only with loose granular non-cohesive materials such as particulated rock, sand, dry soils, small debris and the like.

If material being excavated is adhesive to adhere to the surface of the carrying excavator bucket, it often may not be removed from the excavator bucket solely by force of gravity and requires other means to remove it. This problem is exacerbated if the material is also cohesive. The problem of cohesiveness is common with soil materials consisting of, or containing, wet clay, various finely particulated soil materials or debris containing wet clay or other material that is both cohesive and adhesive. This problem in the past often has been dealt with by a machine operator or another workman manually loosening the material in the excavator bucket to allow removal by the forced gravity acting thereon. Another common solution has been to maintain the excavator bucket in a horizontal dumping position, move it over some resistive surface and attempt to mechanically pound the excavator bucket on the resistive surface to lessen the adhesion and cohesion of the material mass therein by reason of inertia created by the pounding action. These solutions however are labor intensive, time consuming, not cost efficient and the machine activated pounding process may cause damage to the excavator bucket or the mechanism associated with it.

These problems have heretofore been recognized and responsively various less damaging and less time consuming mechanical methods for removing cohesive and adhesive material from excavator buckets have been devised. None of such methods, however, have completely or adequately resolved the problems, at least for all or a substantial number of the excavator buckets of modern commerce and the various materials causing adhesion and cohesion. The instant mechanism seeks to resolve various of these remaining problems.

One earlier solution for material removal from excavator buckets provided an extractor plate, commonly of curvilinear configuration to fit against the inner surface of the excavator bucket back, that is mechanically moved outwardly between the excavator bucket sides in the containment chamber while the excavator bucket is in a horizontal, downwardly opening dumping position to aid the gravity force in removing material in the bucket chamber therefrom. With such mechanism, material in the excavator bucket remains as cohesive as it was when initially moved into the excavator bucket, or more so, and remains as adhesive to the extractor plate as it was to the bucket inner surface. This solution is not efficiently operative and, if it is operative at all, generally requires substantial power in addition to gravity force to remove material from the excavator bucket. By reason of the substantial power requirement for operation of the extractor plate, many such mechanisms have been powered by new hydraulic linkages that were not originally provided with a back hoe and, if mechanically activated, such linkages have required complex power magnifying linkages which have not proven to be well or efficiently operative, have been short lived and have required substantial maintenance.

In recognition of these problems some later more modern excavator bucket cleaning systems have provided cleaning members of lesser area than the area of the back of the excavator bucket to be cleaned. Such known devices have commonly used multiple band-like elements to move over and along portions of the excavator bucket interior. These multiple band-like elements generally have been configured to fit against portions of the inner surface of the excavator bucket and while diverging therefrom pivot to release material in the bucket. Such multiple band-like devices have generally been complex, have been adapted for use only with particular excavator buckets and in use have not proven to be particularly efficient or effective in removing all or substantial amounts of contained material from the excavator buckets they service. Various such systems have continued to suffer the mechanical problems associated with the large plate devices, have not been easily retrofitable on pre-existing machines they service and have required complex mechanical linkages that use substantial force to accomplish their motion. The complexity of such more modern cleaning systems generally has required such modification of excavator buckets, their ordinary mechanical linkages, or both as to require the ejector mechanism to be created during the manufacture of the excavator bucket and generally make impractical the retroactive installation of the systems in existing extractor buckets and their moving mechanisms, at least by ordinarily skilled mechanics in the art.

In contradistinction the instant ejector mechanism provides relatively narrow ejector arms that are carried in laterally spaced adjacency on an interconnecting ejector arm shaft journaled between the ejector bucket sides for pivotal motion along each side of the excavator bucket and away from the lower portion of the bucket back. This structure provides ejector arms of substantially less surface area than the bucket back that in their motion scrape material from the lower portion of the bucket sides. The ejector arms yet provide quite sufficient area to eject material from the excavator bucket when in unloading position, but not enough area to allow adhesion of any substantial amount of material in the excavator bucket.

The mounting and positioning of the ejector arms allow simple mechanical innerconnection of the ejector arm shaft carrying them with a powering arm that extends forwardly through the bucket back to communicate with excavator bucket pivoting structure to provide automatic operation of the ejector mechanism responsive to the angular position of the excavator bucket relative to the support arm carrying it and powering by the hydraulic system that powers the pivoting motion of the excavator bucket. This simplified ejector mechanical structure allows retrofitable installation of the instant ejector system in many, if not most, of back hoe mechanisms of modern day commerce with only minimal modification that may be readily accomplished by relatively unskilled workmen with only such knowledge and ability as is common to operators and mechanics who normally deal with back hoes in their routine operation and maintenance.

SUMMARY OF INVENTION

My invention provides an ejector mechanism for a back hoe excavator bucket that is automatically operated and powered by the back hoe excavator bucket tilting mechanism. The ejector mechanism in a first species provides a horizontally oriented ejector arm axle mounted between the inner surfaces of the of the excavator bucket sides to pivotally carry an ejector arm sleeve which in turn irrotatably carries two spaced elongate ejector arms configured to fit against the opposed lateral portions of the excavator bucket back and pivot along the bucket sides. In a second species the ejector arm axle is pivotally carried by the excavator bucket back and irrotatably carries the two spaced ejector arms. A powering arm irrotatably carried by the ejector arm sleeve or ejector arm axle extends forwardly, with reference to the back hoe vehicle, toward tilting linkage interconnecting the back hoe tilting cylinder with the excavator bucket. The forward end of the powering arm carries a roller to move on an adjustable powering arm ramp, in the first species carried by the bucket support arm and in the second species carried by the excavator bucket tilting linkage that pivots the bucket between loading and unloading positions. Biasing springs communicate with the ejector arm axle or ejector arm sleeve to bias the ejector shafts to a position with the ejector arms carried thereby immediately adjacent the inner surface of the bucket back. Power connecting linkage provides a compound adjustable powering arm ramp carried by the bucket support arm in the first species, and the bucket tilting arm linkage in the second species to provide a downward and rearwardly angulated surface upon which the roller in the forward portion of the powering arm may move as the excavator bucket is tilted to a horizontal dumping position to responsively pivot the ejector arms from a null biased position immediately adjacent the bucket back to a position pivotally distant therefrom. This motion of the ejector arms causes material carried in the excavator bucket to be released from adherence to the bucket back and sides to allow gravity to act upon the material to aid removal from the excavator bucket. In the first species of ejector mechanism the ejector arm sleeve is carried in the excavator bucket closely adjacent the upper edge of the excavator bucket and in the second species the ejector arm axle is carried in the vertically medial portion of the back of the excavator bucket.

In providing such mechanism it is:

a principal object to provide an ejector mechanism for the excavator bucket of a back hoe that operates automatically responsive to motion of the excavator bucket between loading and unloading positions.

A further object is to provide such an ejector mechanism that has a relatively small surface area contacting material in the excavator bucket to be unloaded to substantially lessen the amount of adhesion of the material in the bucket with the ejector mechanism.

A further object is to provide such an ejector mechanism that has simple mechanical linkages that allow the mechanism to be retrofitable on many existing excavator buckets of various manufacturers as well as being installable in new buckets in the manufacturing process.

A still further object is to provide such an ejector mechanism that has laterally spaced ejection arms that not only move ejectable material in the ejector bucket forwardly out of the bucket but at the same time scrape the inner surface of the bucket sides to release material adhering thereto.

Yet another object is to provide such an ejector mechanism that is of new and novel design, of a rugged and durable nature, of simple and economic manufacture and one that is otherwise well-suited to the uses and purposes for which it is intended.

Other and further objects of my ejector mechanism will appear from the following specification and accompanying drawings which form a part hereof. In carrying out the objects of my invention, however, it is to be understood that its features are susceptible of change in design and structural arrangement with only the preferred and practical embodiments of the best known modes being illustrated in the accompanying drawings and specified.

BRIEF DESCRIPTIONS OF DRAWINGS

In the accompanying drawings which form a part hereof and wherein like numbers of reference refer to similar parts throughout:

FIG. 12 is a rearward looking isometric view of the right side and forward surface of the excavator bucket mechanism of FIG. 8 to more clearly illustrate portions of the second species of my ejector mechanism from this aspect.

FIG. 13 is an enlarged partial vertical cross-sectional view of the medial portion of the excavator bucket mechanism of FIG. 12, taken on the line 13—13 thereon in the direction indicated by the arrows, to show finer details of the biasing mechanism of the second species of ejector structure.

DESCRIPTION OF PREFERRED EMBODIMENT

My invention generally provides ejector mechanism 12 in a first species and ejector mechanism 12A in a second species, both for use on a back hoe vehicle 10 having excavator bucket mechanism 11. The term "ejector arm shaft" as used herein refers to an ejector arm axle and a tubular sleeve carried by an ejector arm axle.

Figure 1:
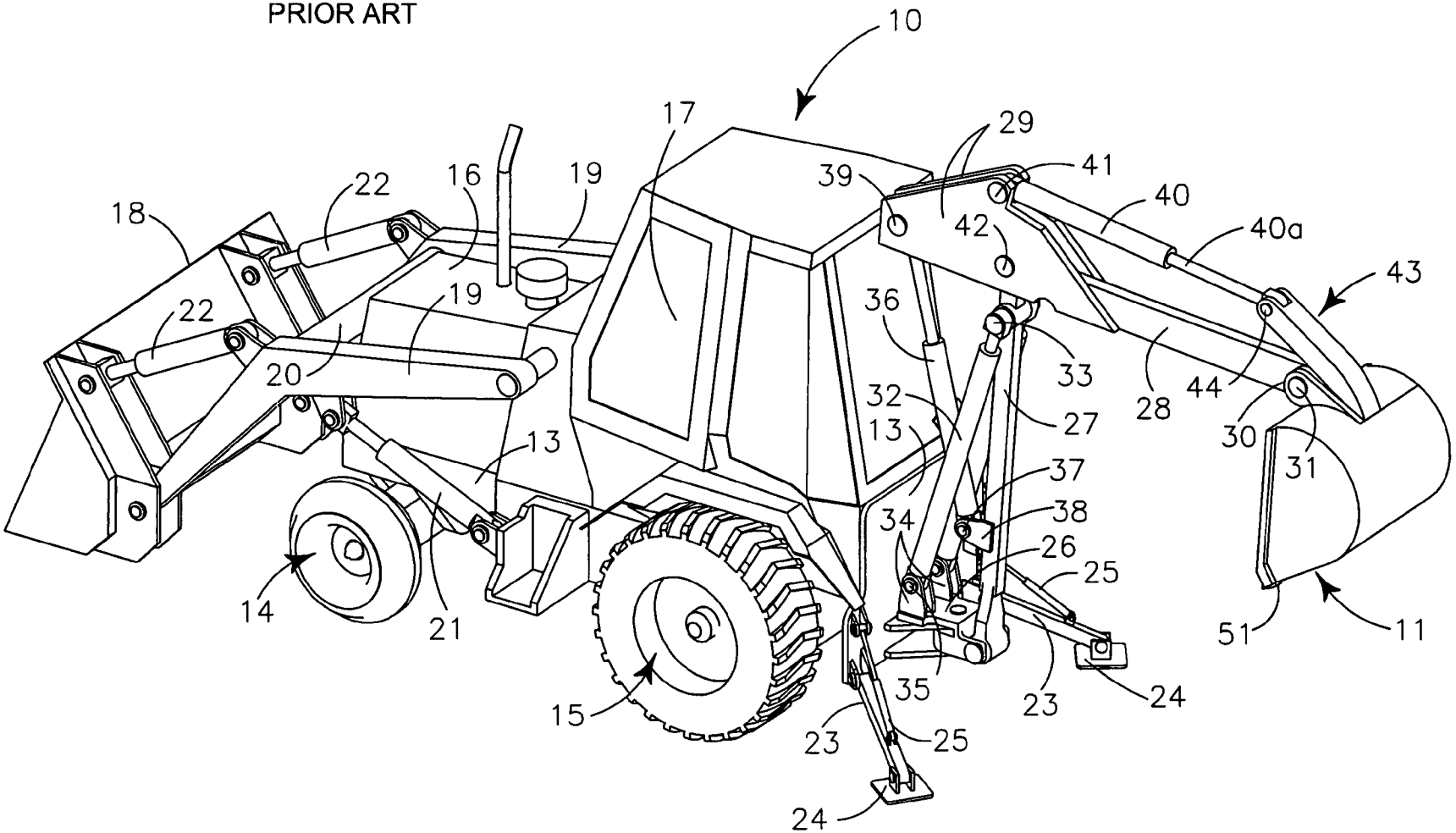
FIG. 1 PRIOR ART
FIG. 1 is a somewhat generic forward looking isometric view of the back and left side of a typical back hoe on which my ejector mechanism may be used.

A somewhat generically illustrated back hoe, typical of such machines in the present day marketplace produced by various manufactures, is illustrated in FIG. 1. The back hoe vehicle 10 provides frame 13, supported on forward steerable wheel truck 14 and rearward driving wheel truck 15, and which in turn support motor structure 16 in its forward portion and operator cab 17 in its rearward portion. The forward portion of the back hoe vehicle 10 mounts larger load moving bucket 18 pivotally carried by similar laterally spaced angulated load moving bucket arms 19 pivotally supported on the upper elongately medial portion of frame 13. The load moving bucket arms 19 are interconnected by longitudinally medially positioned cylindrical beam 20 which interconnects and requires similar vertical motion of the load moving bucket arms 19. Paired opposed lifting cylinders 21 are pivotally supported on the lower elongately medial portion of frame 13 to pivotally communicate with the lower medial portions of load moving bucket arms 19 to raise and lower load moving bucket 18. Similar paired laterally opposed load moving bucket tilting cylinders 22 extend forwardly from the upper medial portions of each load moving bucket arm 19 to pivotally interconnect with the opposed lateral portions of load moving bucket 18 to allow adjustable tilting of the load moving bucket 18 between load carrying and load dumping positions throughout the range of vertical motion of the load moving bucket 18.

The rearward lateral portions of frame 13 each pivotally carry rearwardly and downwardly extending vehicle support beams 23 having pivotally mounted support feet 24 in their outer end portions. Adjustable support beam hydraulic cylinders 25 pivotally communicate between the upper surfaces of the outer end portion of each vehicle support beam 23 to positions of pivotal support on frame 13 spacedly vertically above the points of support of the vehicle support beams 23 on the frame 13. This structure may be operated to absorb at least some of the vertical load on the wheels of rearward wheel truck 15 and additionally provide support against vertically orientated tipping moments that potentially could rotate the back hoe vehicle 10 in a rearward direction about its rearward wheel truck 15.

Excavator bucket mechanism 11 provides rearwardly extending mounting platform 26 supported on the laterally medial lower portion of frame 13 to extend spacedly rearwardly therefrom. The mounting platform 26 in its rearward portion carries vertical support beam 27 for pivotal motion in an elongately extending vertical plane. Vertical support beam 27 pivotally supports excavator bucket support arm 28 in its forwardly medial portion and in its forward portion carries two similar spacedly adjacent connector plates 29 on each side to aid pivotal interconnection of hydraulic cylinders that provide various motions for excavator bucket 51. The rearward end portion of excavator bucket support arm 28 pivotally carries excavator bucket 51 by means of paired opposed support brackets 30 structurally carried by curvilinear back 48 with pin 31 extending through the support brackets 30 and excavator bucket support arm 28 carried therebetween.

The hydraulic system that moves excavator bucket 51 provides two similar laterally spaced angulating hydraulic cylinders 32 pivotally interconnected in their upper end portions on the upper portion of vertical support beam 27 by pin 33 extending therebetween. The lower end portions of angulating hydraulic cylinders 32 are pivotally carried in brackets 34 structurally supported on the forward portion of mounting platform 26, forwardly of the interconnection of vertical support beam 27 with mounting platform 26, by pins 35 extending between angulating hydraulic cylinders 32 and brackets 34. Excavator bucket arm pivoting cylinder 36 extends from pivotal carriage in bracket 38 supported on and extending forwardly from the lower medial portion of vertical support beam 27. The upper end portion of excavator bucket arm pivoting cylinder 36 is pivotally carried between the forward portions of connector plates 29 by pin 39 extending therebetween. The forward end portion of excavator bucket tilting hydraulic cylinder 40 is pivotally mounted, at a position above pin 42 interconnecting excavator bucket support arm 28 and vertical support beam 27, between connector plates 29 by pin 41 extending therebetween. The piston shaft 40*a* of excavator bucket tilting hydraulic cylinder 40 is pivotally interconnected with bucket tilting beam 43 by pin 44 extending therebetween.

Bucket tilting beam 43, as seen in FIGS. 2–5, provides a compound lever system having similar paired opposed bell crank levers 45 with longer arms 45*a* pivotally mounted on excavator bucket support arm 28 by pin 46 extending therebetween. Shorter angled arms 45*b* of bell crank levers 45 pivotally carry straight lever 47 therebetween by means of pin 73 extending through a first end portion of straight lever 47. The second end of straight lever 47 is pivotally carried between support brackets 30 by pin 74 extending therebetween. With this linkage then as piston shaft 40*a* of excavator bucket tilting hydraulic cylinder 40 is extended in a rearward direction, excavator bucket 51 will be pivoted in a clockwise direction from the dumping position seen in FIGS. 4 and 5. This basic linkage is common in back hoes of the present day marketplace and used, in its essence at least, by various manufacturers.

Excavator bucket 51 is a scoop-like structure formed by curvilinear back 48, having upper inner edge 48*a* and lower outer edge 48*b*, interconnecting two similar planar sides 49. Commonly the lower outer edge 48*b* is provided with teeth 50 to aid digging operations and the outer surfaces of each planar side 49 are often provided with various reinforcing plates at points of greater wear.

Both the structures and operations of back hoes in the modern marketplace have become somewhat standardized by various manufactures and the foregoing description of such machines is generally generic to many present day back hoes. It is with such back hoes that my ejector mechanism is operative.

The first species of my ejector mechanism 12, as illustrated in various aspects in FIGS. 2–7, provides elongate ejector arm axle 52 carried between opposed planar sides 49 of excavator bucket 51. The ejector arm axle 52 pivotally carries tubular ejector arm sleeve 53 extending axially thereover and spacedly adjacent the interior of each excavator bucket planar side 49 to allow pivotal motion of the ejector arm sleeve 53 within material containment chamber 54 defined by the excavator bucket 51.

Figure 3:
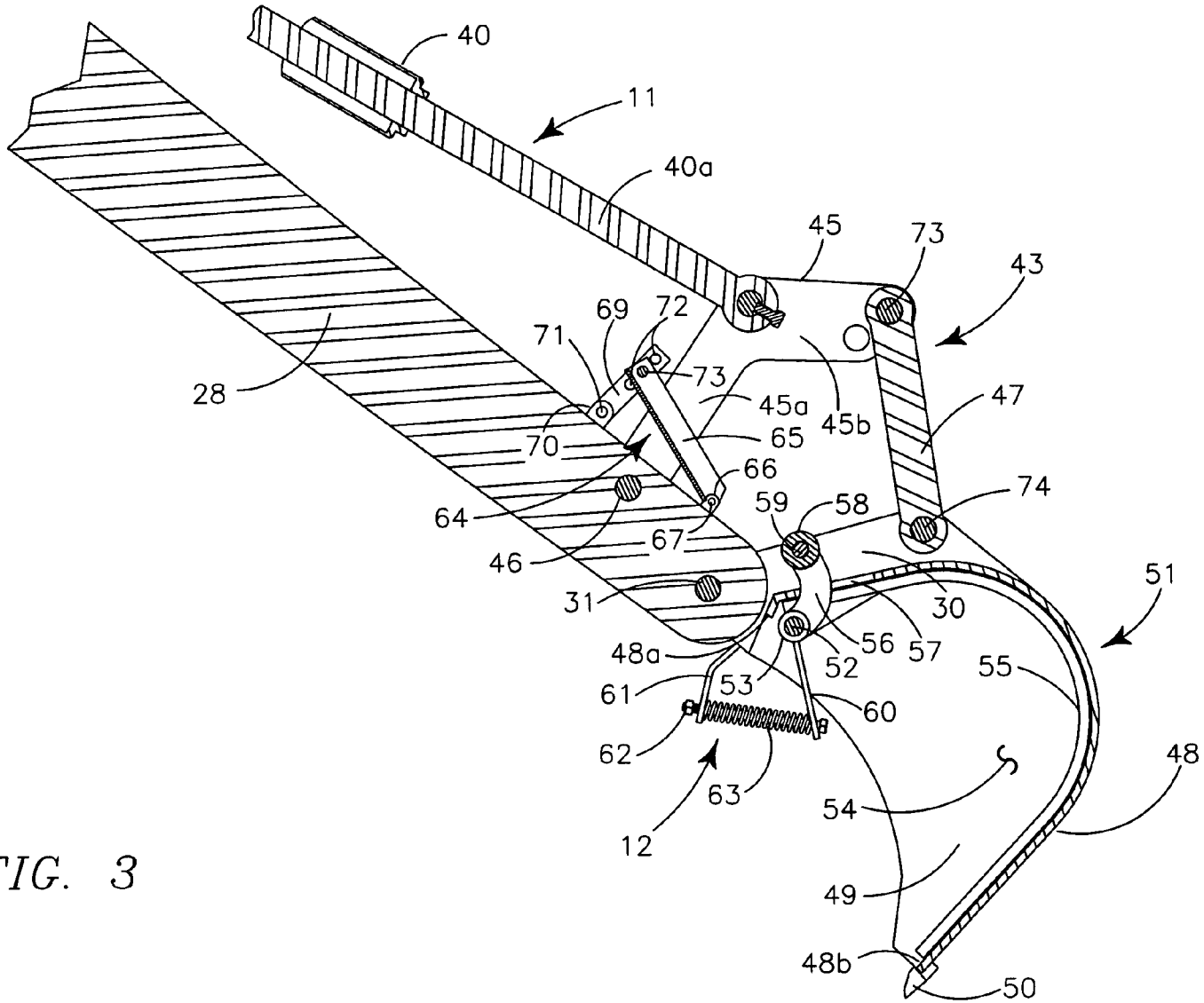
FIG. 3 is a medial vertical cross-sectional view of the ejector mechanism of FIG. 2, taken on the line 3—3 thereon in the direction indicated by the arrows.
Figure 4:
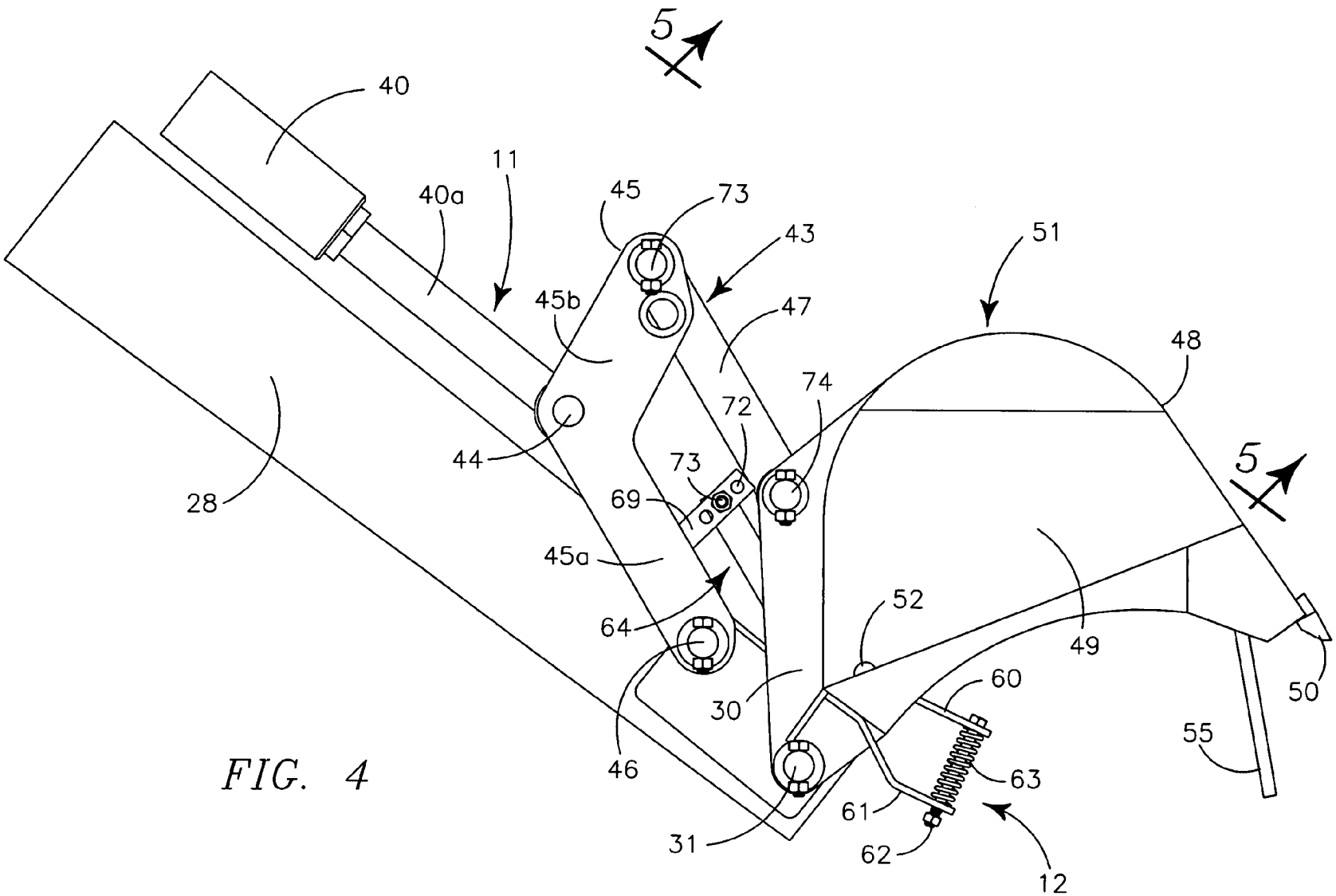
FIG. 4 is a left side orthographic view of the first species of the ejector mechanism showing the excavator bucket mechanism in horizontal dumping position.

The lateral end portions of ejector arm sleeve 53 each structurally irrotatably carry similar paired opposed ejector arms 55. The ejector arms 55 are elongate curvilinear strip-like elements having a curvature such that when pivoted to a position immediately adjacent the inner surface of curvilinear back 48 of excavator bucket 51, the ejector arms 55 will be in substantial adjacency to the curvilinear back 48 as seen in FIG. 3. The length of the ejector arms 55 preferably should be such as to extend substantially to lower outer edge 48*b* of curvilinear back 48 but, depending on material to be ejected, may be less. The width in a horizontal direction of each of the ejector arms 55 may vary somewhat depending upon the nature of the material to be ejected from the excavator bucket 11, but the width should be substantially less than of the width of bucket back 48 between bucket planar sides 49, and preferably less than about 20% of the width of curvilinear back 48, so that the surfaces of the ejector arms 55 in contact with material in excavator bucket 51 will not cause or allow adhesion of substantial amounts of that material to the surfaces of the ejector arms 55. To further enhance this action ejector arms 55 may taper to a narrower width in an outward direction. This tapered configuration may provide the additional benefit of creating a larger cross-sectional area and thus greater strength in inner portions of the ejector arms 55 that carry greater portions of the stress imposed upon them. The ejector arms 55 preferably are positioned on the ejector arm sleeve 53 so that their laterally outer edges are closely inwardly of the adjacent inner surfaces of each planar side 49 of excavator bucket 51 so that the ejector arms 55 move substantially along the inner surface of the planar sides 49 when pivoted to an unloading position to tend to scrape material adhering to the planar side 49 therefrom.

Figure 5:
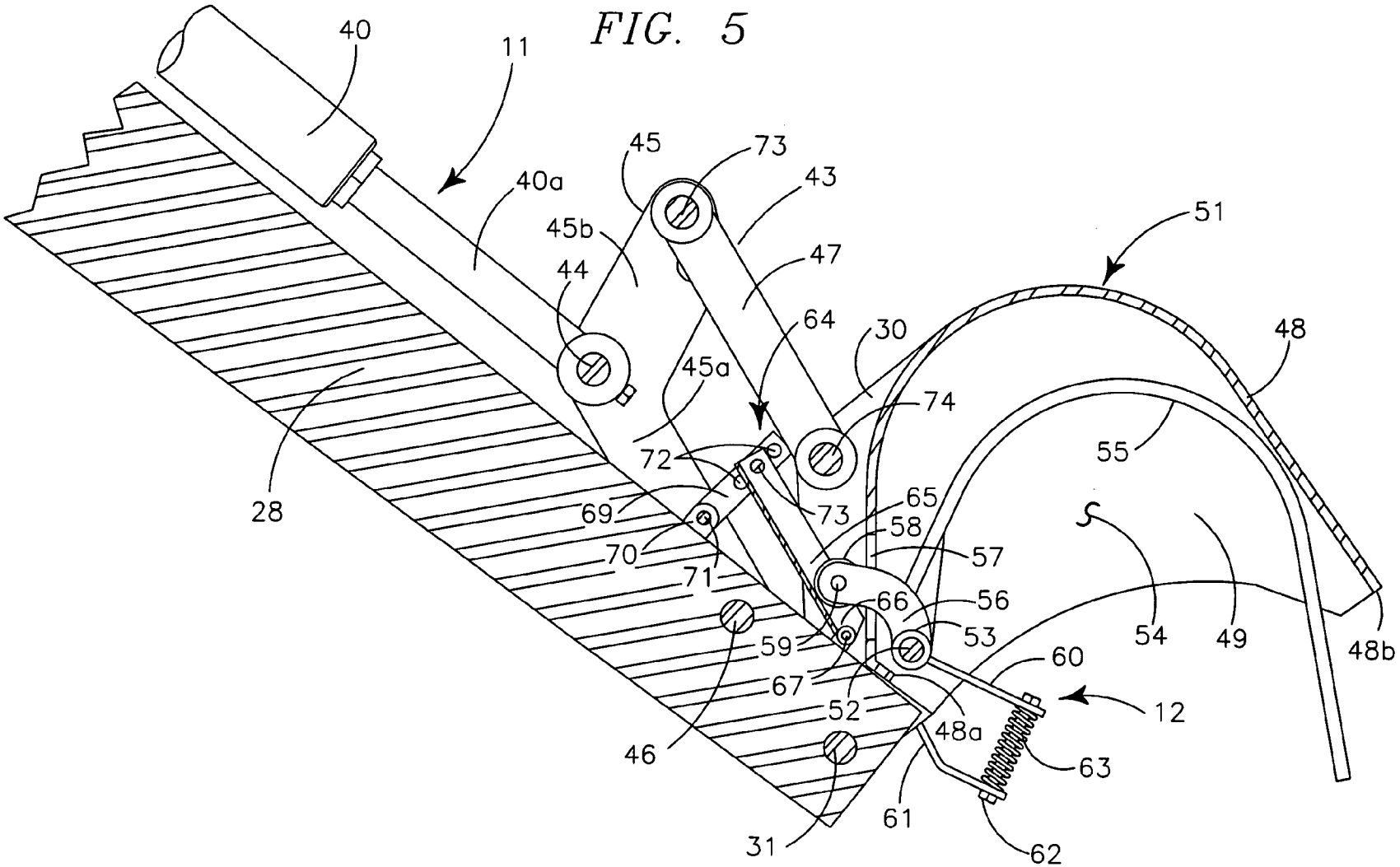
FIG. 5 is a medial vertical cross-sectional view of the ejector mechanism of FIG. 4, taken on the line 5—5 thereon in the direction indicated by the arrows.
Figure 7:
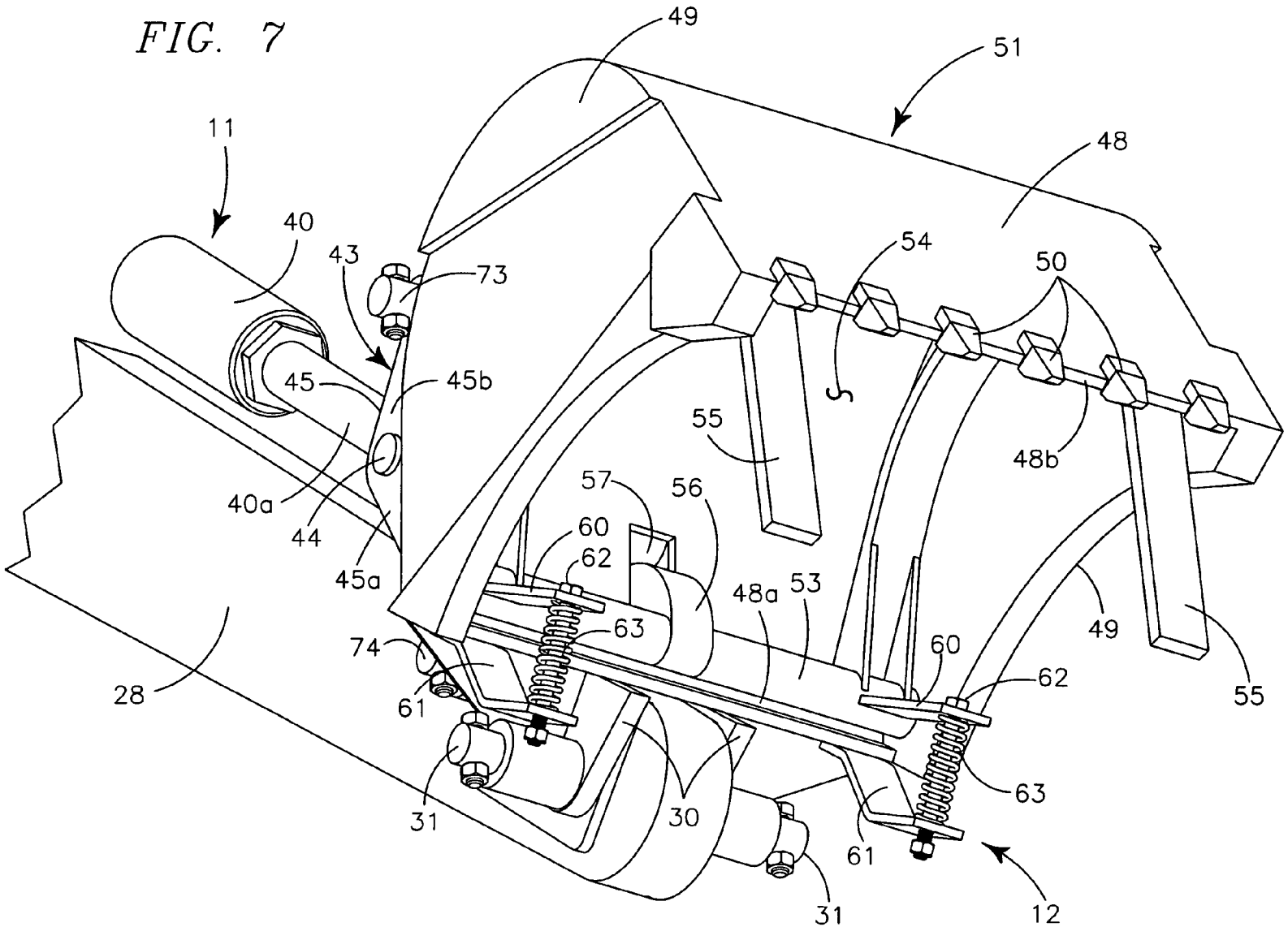
FIG. 7 is an isometric forward looking view of the bottom and left side of the excavator bucket of FIG. 6 with the excavator bucket in horizontal dumping position.

As seen especially in FIGS. 3, 5 and 7 powering arm 56 is irrotatably carried on the laterally medial portion of ejector arm sleeve 53 to extend forwardly therefrom through powering arm orifice 57 defined in the laterally medial portion of curvilinear back 48 of excavator bucket 51 spacedly adjacent the upper edge 58*a*. Powering arm 56 pivotally carries roller 58, mounted on axle 59, in a slot defined in its forward portion to roll upon a powering arm ramp 65 with minimal friction or obstruction.

As seen especially in FIG. 7 ejector arm sleeve 53 in each lateral end portion carries compression spring arm 60 that extend away from curvilinear back 48 of excavator bucket 51. Similar opposed compression spring reaction arms 61 are structurally carried on the outer surface of inner upper edge 48*a* of excavator bucket 51 to extend in the same direction as compression spring arms 60 and in spaced adjacency therefrom. Nut/bolt combinations 62 extend between the outer end portions of each cooperating pair of compression spring arms 60 and compression spring reactor arms 61 to carry compression springs 63 about the bolts of the nut/bolt combinations 62 and between the cooperating pairs of spring arms 60,61. This structure biases powering arm 56 to a position illustrated in FIG. 3, with the ejection arms 55 immediately adjacent the inner surface of curvilinear back 48 of excavator bucket 51, but yet allows the powering arm 56 to move to an ejecting position as shown in FIGS. 5 and 7 against the bias of the compression springs 63.

Powering arm ramp 64 provides rearward ramp element 65 having a "U" shaped cross-section and pivotally interconnected with the rearward surface of excavator bucket support arm 28 by bracket 66 structurally carried on the excavator bucket support arm 28 with nut/bolt combination 67 extending between the bracket 66 and rearward ramp element 65.

A forward portion of rearward ramp element 65 is pivotally supported by similar paired opposed support arms 69 that are pivotally carried in bracket 70 by nut/bolt combination 71 extending therebetween. Bracket 70 is positioned forwardly of bracket 66 in such position that the portion of rearward ramp element 65 will be supported in an angulated orientation with the forward portion angulating away from excavator bucket support arm 28. The support arms 69 define a plurality of lineally spaced opposed pairs of holes 72 to receive nut/bolt combination 73 extending therethrough and through the forward portion of rearward ramp element 65 to allow adjustable angulation of the rearward ramp element 65. The powering arm ramp structure 64 is so positioned on excavator bucket support arm 28 that roller 58 of powering arm 56 will roll upon rearward ramp element 65 when excavator bucket 51 is pivoted to a dumping position as shown FIG. 5 to responsively move ejector arms 55 away from curvilinear back 48 of the excavator bucket 51.

A second species of ejector mechanism 12A shown in FIGS. 8–13 provides elongate ejector arm axle 74, having length slightly less than the distance between opposed planar sides 49 of excavator bucket 51 to fit therebetween, journaled in bushing 75 as seen especially in FIG. 12. Bushing 75 is carried on the inner surface of curvilinear back 48 of excavator bucket 51 by plural U-bolts 76 extending over the bushing 75 and forwardly through holes defined in curvilinear back 48 to be fastened by nuts to pivotally support the ejector arm axle 74 on the curvilinear back 48.

The lateral end portions of ejector arm axle 74 each irrotatably structurally carry similar paired opposed ejector arms 77 which are similar to ejector arms 55 of the first species. The ejector arms 77 preferably are carried on the ejector arm axle 74 immediately inwardly of each of its ends so that the laterally outer sides of the ejector arms 77 are adjacent the inner surface of each planar side 49 of the excavator bucket 51 and move substantially along the inner surfaces of the planar sides 49 when pivoted to a dumping position.

Figure 11:
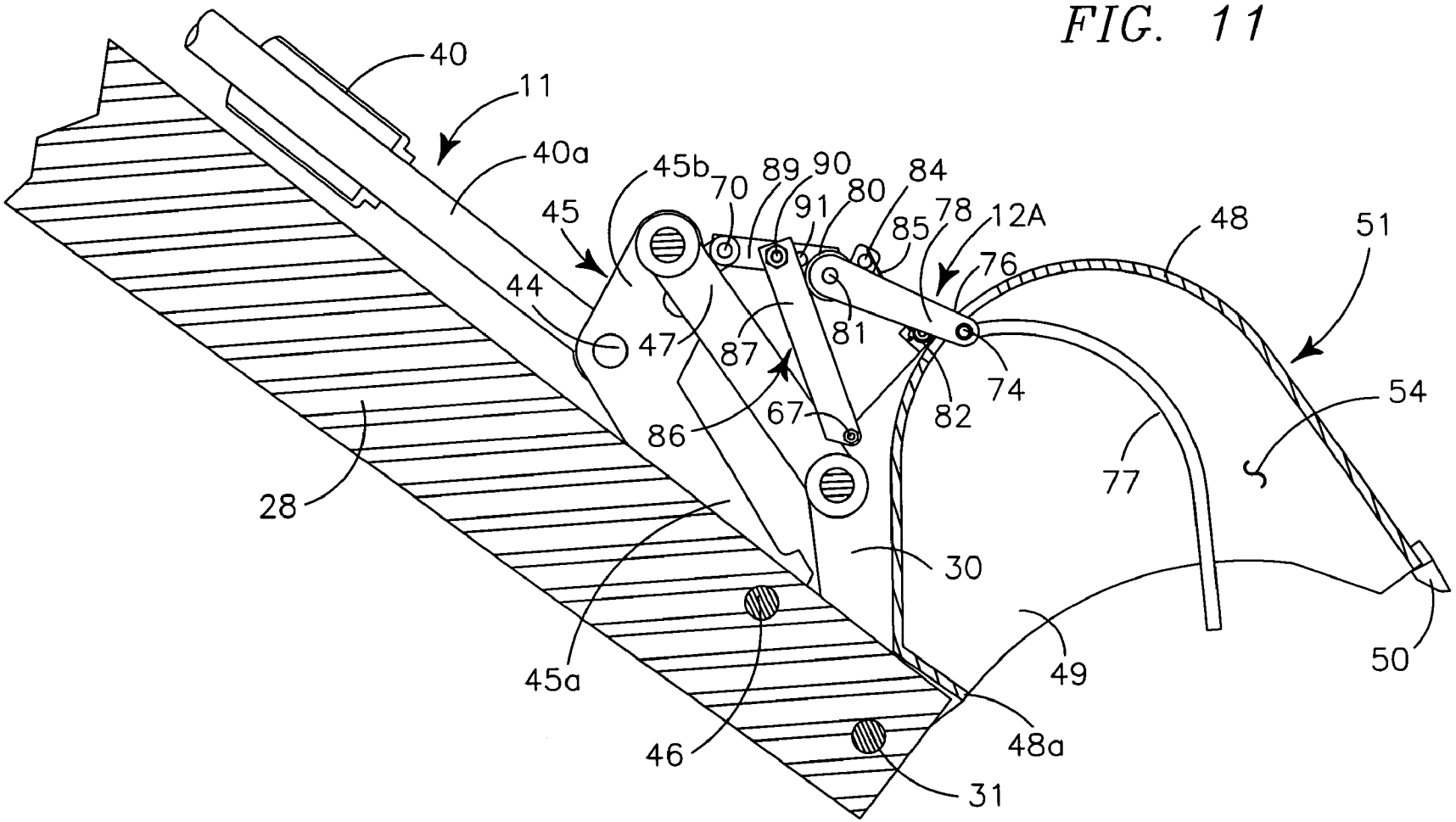
FIG. 11 is a medial vertical cross-sectional view similar to FIG. 10, as would appear if taken on the same line 10—10 of FIG. 8 in the direction indicated by the arrows, with the excavator bucket pivoted to a horizontal dumping position.

As seen especially in FIGS. 11 and 13 elongate powering arm 78 is irrotatably carried on the laterally medial portion of ejector arm axle 74 to extend forwardly therefrom through powering arm orifice 72 defined in the medial portion of curvilinear back 48 of excavator bucket 51. The powering arm 78 carries roller 80 mounted for rotation on axle 81 in its forward portion. Powering arm axle 82 is carried in powering arm axle brackets 83 structurally carried on the forward surface of curvilinear back 48. The powering arm 78 carries horizontally orientated laterally extending biasing axle 84 on its upper surface in a forwardly medial position. Paired opposed torsion springs 85 irrotatably carried by powering arm axle 82 have biasing arms extending forwardly over biasing axle 84 as illustrated especially in FIGS. 8, 11 and 13 to bias ejector arm axle 74 to a pivotal position whereat ejector arms 77 are adjacent curvilinear back 48 of excavator bucket 51, but allow motion of the ejector arms 77 against their bias and away from the curvilinear back 48 when the excavator bucket 51 is in an ejecting position.

Powering arm ramp 86 is formed by ramp element 87 having a "U" shaped cross-section and releasably pivotally interconnected with bracket 75 carried by straight lever 47 of bucket tilting beams 43 by nut/bolt combination 88 extending therebetween. A "U" shaped bracket element 89 is pivotally interconnected to the upper forward portion of straight lever 47 by nut/bolt combination 70 extending therebetween. The medially rearward portion of the "U" shaped bracket element 89 and the forward portion of "U" shaped bracket element 87 are releasably interconnected by nut/bolt combination 90 extending therebetween to allow angular adjustment of the ramp element 87 relative to bucket straight lever 47 of the bucket tilting beams 43.

Having thus described the structure of my ejector mechanisms, their operations and functions may be understood.

An ejector mechanism 12 or 12A as hereinbefore specified and illustrated is created and installed, either during or after manufacture of the excavator bucket mechanism 11, with appropriate dimensional and configurational modification for a particular back hoe that is to carry it, which work is within the skill of a routiner back hoe mechanic or engineer. The back hoe then, with the ejection mechanism embodied therein, may be operated in its habitually familiar fashion as my ejector mechanism does not affect that normal operation.

Figure 8:
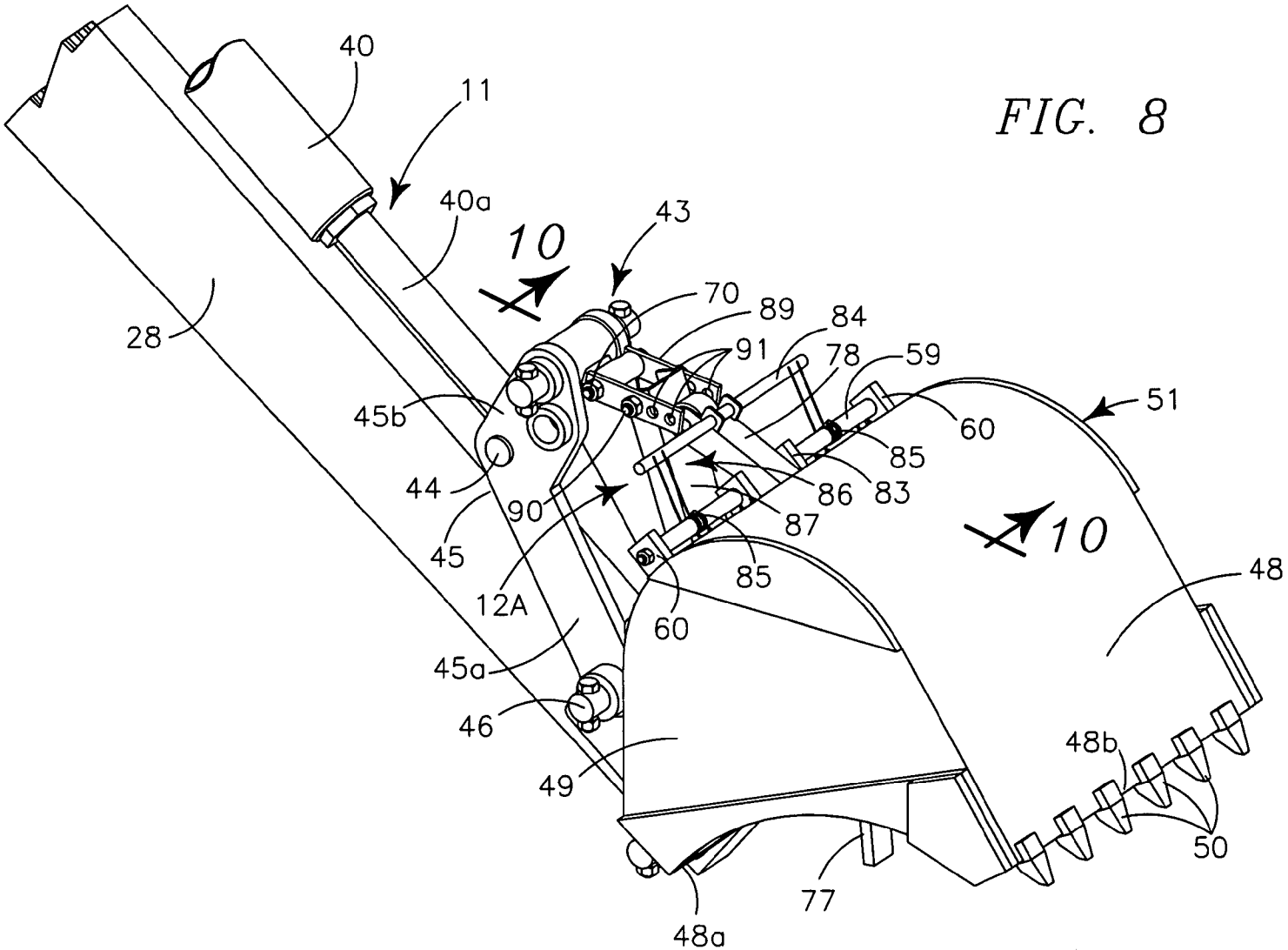
FIG. 8 is a forward looking isometric view of the left side and back of the excavator bucket mechanism of FIG. 1 embodying the second species of my ejector mechanism with the excavator bucket pivoted to a dumping position.
Figure 9:
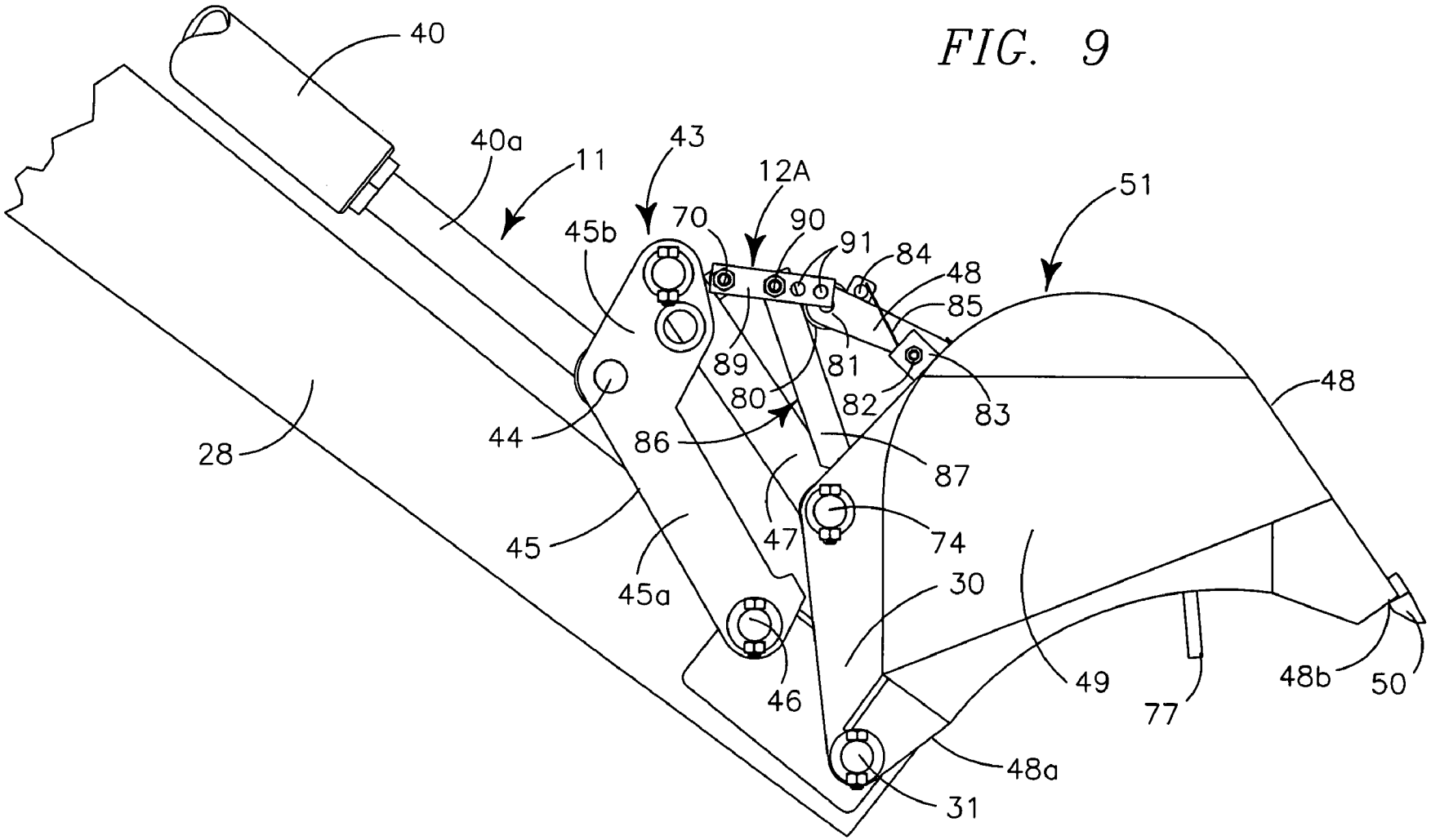
FIG. 9 is an orthographic left side view of the excavator bucket mechanism of FIG. 8.
Figure 10:
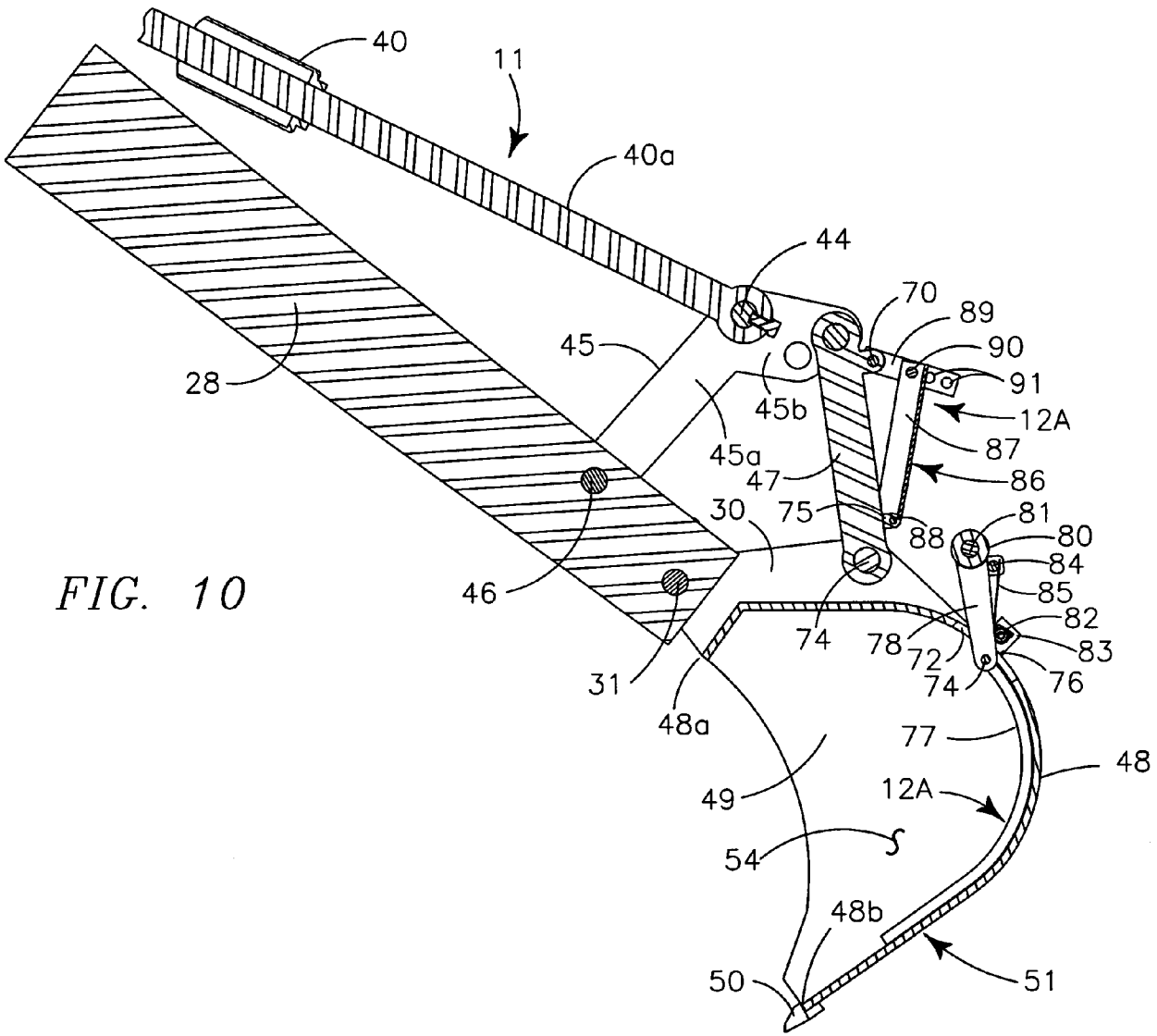
FIG. 10 is a medial vertical cross-sectional view of the excavator bucket mechanism of FIG. 8, as would appear if taken on line 10—10 on FIG. 8 in the direction indicated by the arrows, with the excavator bucket pivoted to a semi-vertical digging position.

My ejector mechanism 12A is shown in FIGS. 10 and 12 with ejector arms 77 biased rearwardly against the inner surface of curvilinear back 48 of excavator bucket 51. The excavator bucket 51 in this position is in its digging or scooping mode and is operated to move forwardly to fill the material containment chamber 54 with a load of earth or other material to be excavated. When filled excavator bucket 51 is moved, by use of the normal back hoe controls, over and vertically above a site whereat the material in the excavator bucket 11 is to be deposited. When in this position controls for bucket tilting hydraulic cylinder 40 are operated to retract piston shaft 40*a* toward cylinder 40 to cause excavator bucket 51 to move pivotally to a horizontal dumping position such as illustrated in FIGS. 8, 9 and 11. As this excavator bucket 51 motion occurs it will move ejector powering arm 78 forwardly to contact ramp element 87 to thence move upwardly and forwardly along the ramp element 87 to a position as shown especially in FIGS. 8 and 11. As this motion occurs powering arm 78 will pivot powering arm axle 82 to pivotally move the irrotatably carried ejector arms 77 away from curvilinear back 48 to a position substantially as shown in FIG. 11. By reason of this motion of the ejector arms 77 some material in excavator bucket 51 adjacent planar sides 49 and outwardly of ejector arms 77 will be loosened and moved away from the elements defining bucket chamber 71. This will cause a release of lateral pressure in the material remaining in bucket chamber 71 which responsively will release some cohesion of the material in the medial portion of excavator bucket 51 to allow gravity to act thereon to further lessen the cohesiveness of that material and thereby aid the action of gravity in moving the material from the excavator bucket 51. After the excavator bucket 51 is unloaded, it is pivoted to extend piston shaft 40*a* away from bucket tilting hydraulic cylinder 40 to pivot the excavator bucket 51 downwardly and forwardly in a clockwise direction to the excavating position shown in FIGS. 10 and 12. As this motion occurs torsion springs 85 carried on powering arm axle 82, by reason of their bias, will pivot the powering arm axle 82 to an angular position whereat ejector arms 77 carried by powering arm axle 82 will be adjacent the inner surface of curvilinear back 48 of the excavator bucket 51. In this position the excavator bucket 51 will be ready for another excavating operation to continue its operative cycle as heretofore described. This ejector mechanism 12A operates entirely automatically responsive to the normal operation of excavator bucket 51 and does not in anyway interfere with the normal and habitually familiar operation of the excavator bucket 51.

Figure 2:
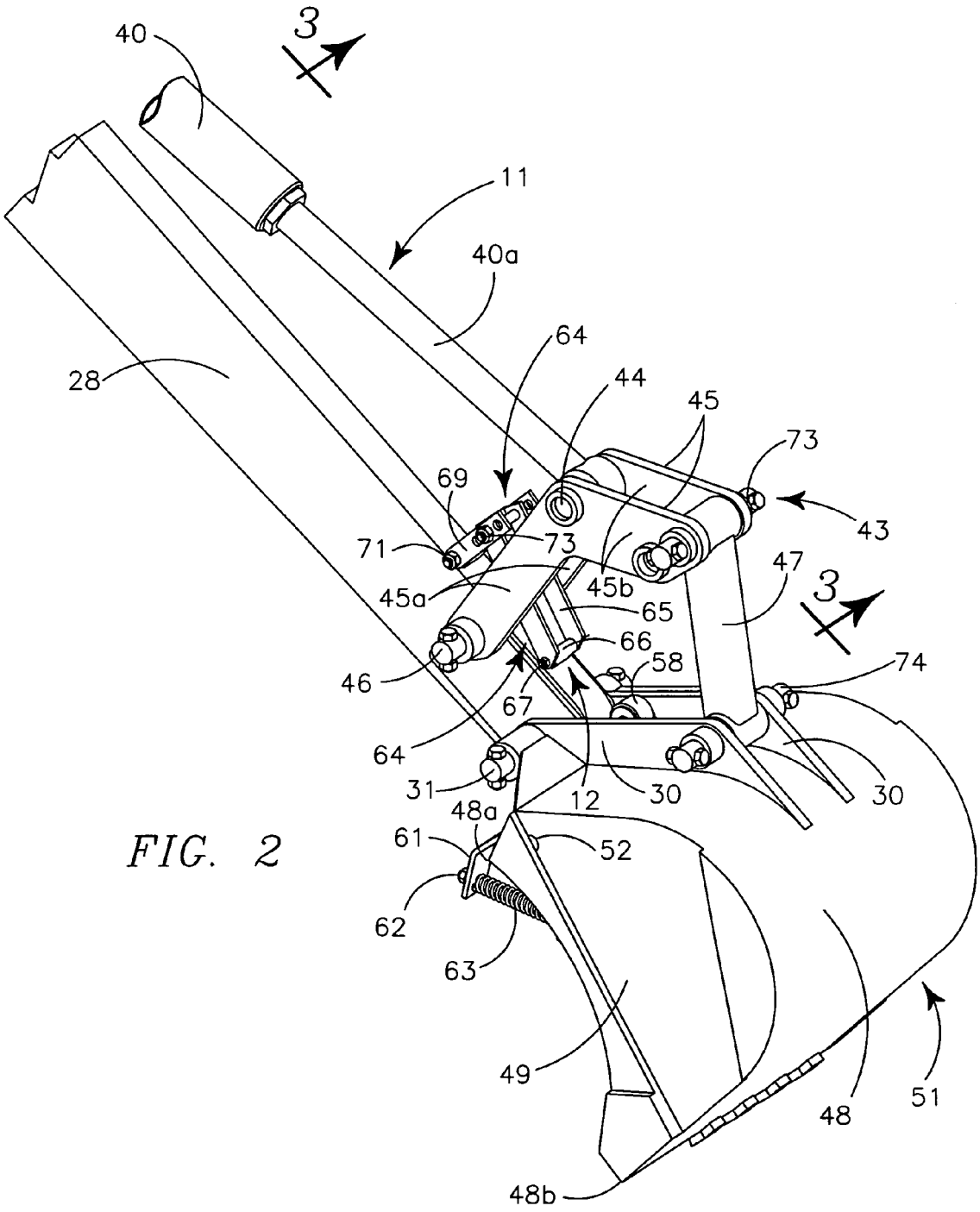
FIG. 2 is a forwardly looking top and left side view of the excavator bucket mechanism of FIG. 1 in semi-vertical digging position with a first species of my ejector mechanism installed thereon.
Figure 6:
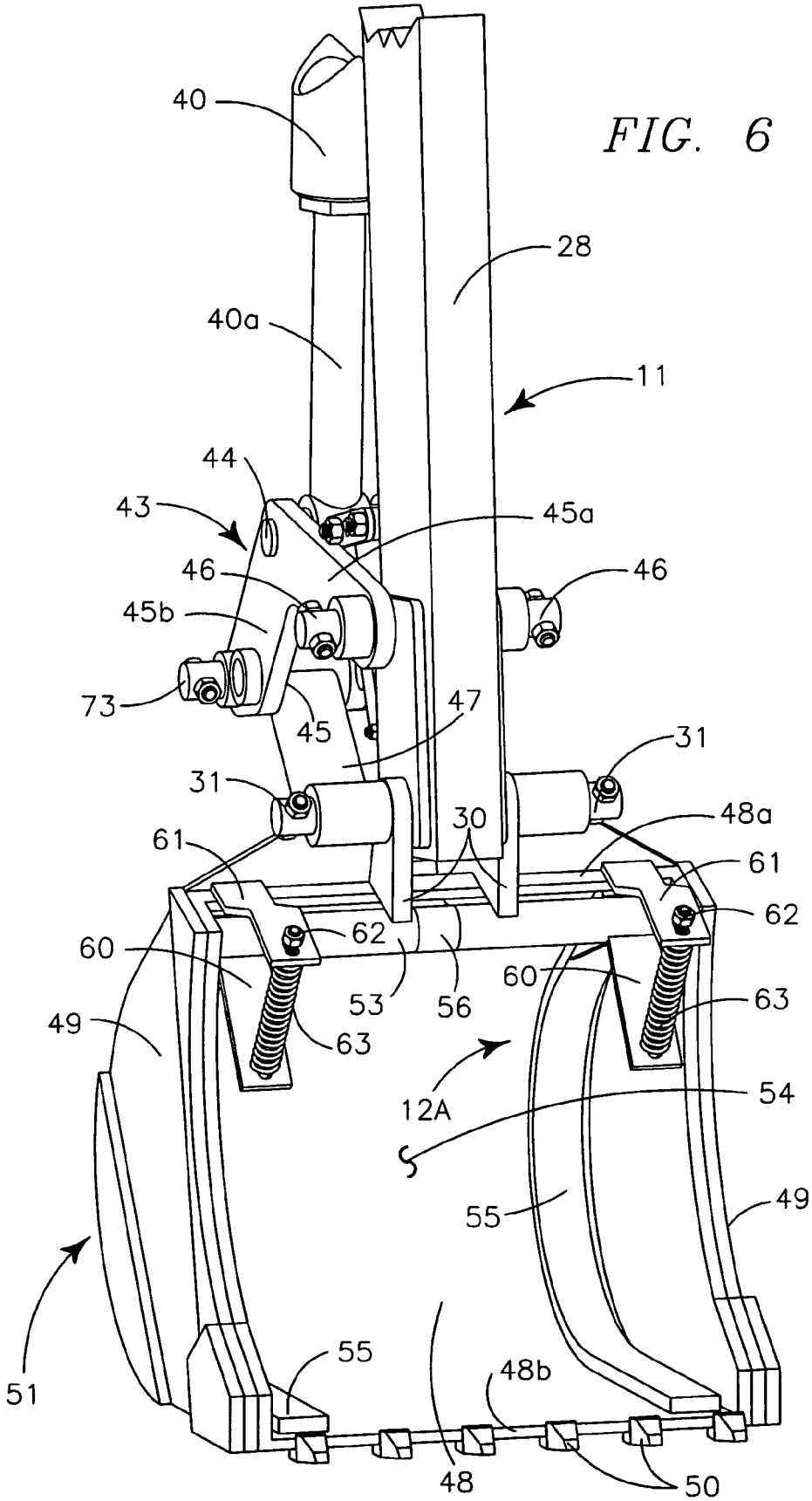
FIG. 6 is a rearward looking isometric view of the front and left side of the excavator bucket mechanism of FIG. 2 showing the first species of the ejector mechanism in digging position.

The operation of the first species of ejector mechanism 12 is substantially the same as the operation of the second species 12A. As seen in FIGS. 2, 3 and 6 the excavator bucket 51 is in its vertical excavating mode. After material containment chamber 54 of the excavator bucket 51 is filled with material to be excavated the excavator bucket 51 is rotated forwardly and upwardly in a clockwise direction to maintain material in the excavator bucket 51 and excavator bucket support arm 28 is raised to allow pivotal motion and pivoted over a side whereat the material in the excavator bucket 51 is to be deposited by use of the ordinary and traditional back hoe controls. Piston shaft 40*a* of bucket tilting hydraulic cylinder 40 is then retracted inwardly toward hydraulic cylinder 40 to cause excavator bucket 51 to pivot in a counter clockwise direction to a position illustrated in FIGS. 4, 5 and 7. As this occurs, roller 58 of powering arm 56 will contact and roll upon rearward ramp element 65 of powering arm ramp structure 64. As this occurs ejector arm sleeve 53 will be responsively rotated in a clockwise direction to move ejector arms 55 away from the inner surface of curvilinear back 48 of excavator bucket 51 to act as described hereinbefore for the second species of the ejector mechanism to remove material contained in material containment chamber 54 of excavator bucket 51 therefrom.

The surface area of ejector arms 55,77 exposed to material in the excavator bucket 11 is fairly critical to the maximally efficient operation of my ejector mechanism. If the area of the ejector arms 55 exposed to material in the excavator bucket 51 is too great, the ejector mechanism 12 or 12A may have some of the problems of a solid ejector plate, as the portion of material adjacent to the ejector arms 55,77 may not effectively overcome the cohesion of the material and its adhesion to the ejector arms 55,77. On the other hand if the width of ejector arms 55,77 is too small, the ejector arms 55 act essentially like wire or rod type ejector apparatus and suffer from its infirmaries of often failing to overcome the cohesiveness of the material to be ejected and of not breaking the adhesive bond between that material in the interior surface of the excavator bucket 51. Preferably the combined width of ejector arms 55,77 should not be greater than approximately 20% of the width of the excavator bucket 51, measured horizontally between the planar sides 49, though my ejector mechanism structure 12 or 12A is operative, if not maximally so, with some range of variance of this width. Ideally if the ejector mechanism 12 or 12A is to be used extensively with a somewhat uniform type of material, the width of the ejector arms 55,77 may be specifically adjusted for that particular material to maximize ejection properties of the system. This maximization of ejection properties may be determined empirically from experimentation by routiner mechanics in the earth moving machinery servicing arts or theoretically by known engineering routiners in the mechanical or agricultural engineering arts.

Having thusly described my invention, what I desire to protect by Letters Patent, and what I claim is:

1. An ejector mechanism for a back hoe excavator bucket, having two sides with inner and outer surfaces interconnected by a curvilinear back having upper and lower edges to define a forwardly opening bucket chamber, said excavator bucket mounted on bucket support linkage having a bucket support arm and bucket pivoting mechanism for pivotal motion of the excavator bucket between an excavating position and a dumping position, comprising in combination:

an ejector arm shaft having opposed end portions pivotally carried in horizontal orientation in the bucket chamber adjacent the inner surface of the excavator bucket back by the excavator bucket sides, said ejector arm shaft irrotatably carrying at each lateral end portion curvilinear ejector arms configured to fit adjacent the inner surface of the curvilinear back of the excavator bucket inwardly adjacent each bucket side and a powering arm in the medial portion of the ejector arm shaft to extending spacedly forwardly through an orifice defined in the curvilinear back of the excavator bucket;

a powering arm ramp carried by the bucket support linkage with an upwardly and forwardly angulated ramp to receive the forward portion of the powering arm for motion along the powering ramp to pivot the powering arm responsive to pivotal motion of the excavator bucket between a vertical digging position and a horizontal dumping position to responsively pivot the ejector arm shaft to move the curvilinear ejector arms between a position adjacent the excavator bucket back to a position distal therefrom, and spring means biasing the ejector arm shaft to a position whereat the curvilinear ejector arms are adjacent the bucket back when the ejector bucket is substantially empty.

2. The ejector mechanism of claim 1 wherein the ejector arm shaft comprises an ejector arm sleeve pivotally carried on an ejector arm axle carried between sides of the excavator bucket with at least one first compression spring arm carried by the ejector arm sleeve to extend outwardly away from curvilinear back of the excavator bucket, at least one second compression spring arm carried by the outer surface of the upper edge of the excavator bucket back to extend substantially over the at least one first compression spring arm spacedly distant therefrom and a compression spring carried between the at least one first and second compression spring arms to bias the compression spring arms away from each other and responsively bias the ejector arm sleeve to a pivotal position that maintains the ejector arms adjacent the inner surface of the back of the excavator bucket.

3. The ejector mechanism of claim 1 wherein the curvilinear ejector arms are flat band-like elements having a total combined width in a horizontal direction of not more than approximately 25% of the horizontal width of the curvilinear back of the excavator bucket.

4. The ejector mechanism of claim 3 wherein the flat band-like curvilinear ejector arms taper outwardly from their structural support on the ejector arm shaft to a narrower width at their outer end portions.

* * * * *